US010769946B1

(12) United States Patent
Harstad

(10) Patent No.: US 10,769,946 B1
(45) Date of Patent: Sep. 8, 2020

(54) INCENTIVE-COMPATIBLE, ASYMMETRIC-INFORMATION, REAL-TIME TRAFFIC-ROUTING DIFFERENTIAL-ADVICE

(71) Applicant: Ronald M Harstad, Columbia, MO (US)

(72) Inventor: Ronald M Harstad, Columbia, MO (US)

( * ) Notice: Subject to any disclaimer, the term of this patent is extended or adjusted under 35 U.S.C. 154(b) by 253 days.

(21) Appl. No.: 15/495,898

(22) Filed: Apr. 24, 2017

(51) Int. Cl.
*G08G 1/0968* (2006.01)
*G08G 1/01* (2006.01)

(52) U.S. Cl.
CPC ..... *G08G 1/096844* (2013.01); *G08G 1/0133* (2013.01); *G08G 1/0137* (2013.01); *G08G 1/096811* (2013.01); *G08G 1/096855* (2013.01)

(58) Field of Classification Search
CPC ..... G08G 1/096844; G08G 1/0133; G08G 1/0137; G08G 1/14; G08G 1/005; G08G 1/096888; G08G 1/096822; G08G 1/096811; G08G 1/20; G08G 1/202; G08G 1/0141
See application file for complete search history.

(56) References Cited

U.S. PATENT DOCUMENTS 4,843,575 A * 6/1989 Crane ..... E03F 7/00 701/123
5,504,482 A * 4/1996 Schreder ..... G01C 21/26 340/995.13
5,530,441 A * 6/1996 Takatou ..... G08G 1/08 340/937
6,012,012 A * 1/2000 Fleck ..... G08G 1/09685 701/117
6,317,058 B1 * 11/2001 Lemelson ..... G08G 1/07 340/905
6,385,531 B2 * 5/2002 Bates ..... G01C 21/3492 340/992
6,590,507 B2 * 7/2003 Burns ..... G08G 1/096827 340/905
6,611,750 B2 * 8/2003 MacPhail ..... G08G 1/0104 340/993

(Continued)

*Primary Examiner* — Hunter B Lonsberry
*Assistant Examiner* — Luis A Martinez Borrero
(74) *Attorney, Agent, or Firm* — Patent Law Works LLP

(57) ABSTRACT

Real-time, individualized traffic-routing assignments and recommendations are automatically determined and provided to multiple participants traversing through a specific area in association with a given event associated with a particular organization. A set of rules is applied to minimize the time to traverse through the area in association with the event, summed over the multiple participants, accounting for physical and incentive-compatibility constraints. An initial assignment is determined for each participant, based on the rules. Each initial assignment includes a departure time and an initial route for the participant. Updated information is received, such as real-time traffic information. Real-time recommendations are determined for participants, based on the rules accounting for the updated real-time data. Recommendations include suggestions to deviate from initial assignments or previous recommendations, based on the updated information. The initial assignments and real-time recommendations are provided to the corresponding participants, for example by communicating with their mobile devices.

20 Claims, 3 Drawing Sheets

(56) References Cited

U.S. PATENT DOCUMENTS 6,654,681 B1 * 11/2003 Kiendl ..... G01C 21/26 340/905
7,088,229 B2 * 8/2006 Johnson ..... G06K 7/0008 340/505
7,349,768 B2 * 3/2008 Bruce ..... G01C 21/005 701/1
7,386,391 B2 * 6/2008 Morariu ..... B61L 27/0027 701/117
7,877,280 B2 * 1/2011 Jones ..... G06Q 10/02 705/26.4
8,090,530 B2 * 1/2012 Horvitz ..... G01C 21/3492 701/120
8,306,746 B2 * 11/2012 Nortrup ..... G06Q 30/0269 701/465
8,326,793 B1 * 12/2012 Bowers ..... G06F 9/50 706/62
8,392,109 B2 * 3/2013 Liotopoulos ..... G08G 1/0969 701/409
8,406,986 B2 * 3/2013 Boss ..... B61L 27/04 701/117
8,589,057 B2 * 11/2013 Kickbusch ..... B61L 27/0011 701/117
8,738,289 B2 * 5/2014 Ghoting ..... G08G 1/202 701/400
8,825,350 B1 * 9/2014 Robinson ..... G08G 1/0116 701/117
8,825,374 B2 * 9/2014 Dimitriadis ..... G01C 21/3415 701/411
9,047,767 B2 * 6/2015 Hampapur ..... G08G 1/0145
9,212,925 B2 * 12/2015 Bell ..... G01C 21/3492
9,494,441 B2 * 11/2016 Chou ..... G01C 21/36
9,501,928 B1 * 11/2016 Bell ..... H04W 4/21
9,552,725 B2 * 1/2017 Feldman ..... G08G 1/0104
9,612,125 B2 * 4/2017 Goel ..... G01C 21/3476
9,672,734 B1 * 6/2017 Ratnasingam ..... G08G 1/0145
9,761,131 B2 * 9/2017 Robinson ..... G08G 1/0116
9,934,683 B2 * 4/2018 Fowe ..... G08G 1/096716
10,006,778 B2 * 6/2018 Perkins ..... G01C 21/3685
10,026,279 B1 * 7/2018 Beller ..... G08B 25/10
10,181,242 B1 * 1/2019 Beller ..... G09B 21/006
10,354,523 B2 * 7/2019 Jin ..... G08G 1/07
10,408,631 B2 * 9/2019 Delaney ..... G01C 21/3484
10,451,436 B2 * 10/2019 Thomas ..... G01C 21/3694
10,529,230 B2 * 1/2020 Hofman ..... G08G 1/0145
2004/0130463 A1 * 7/2004 Bloomquist ..... G08G 1/096716 340/907
2006/0074544 A1 * 4/2006 Morariu ..... B61L 27/0027 701/117
2006/0082472 A1 * 4/2006 Adachi ..... G08G 1/096716 340/995.13
2006/0089787 A1 * 4/2006 Burr ..... G08G 1/096883 701/533
2006/0149464 A1 * 7/2006 Chien ..... G01C 21/3492 701/533
2007/0293958 A1 * 12/2007 Stehle ..... G06Q 30/0207 700/30
2008/0046134 A1 * 2/2008 Bruce ..... G06Q 10/047 701/1
2009/0299629 A1 * 12/2009 Grigsby ..... G01C 21/3484 701/469
2009/0319172 A1 * 12/2009 Almeida ..... G06Q 30/02 701/533
2010/0268456 A1 * 10/2010 Kantarjiev ..... G01C 21/3453 701/465
2011/0251790 A1 * 10/2011 Liotopoulos ..... G01C 21/3492 701/533
2012/0072096 A1 * 3/2012 Chapman ..... G08G 1/096811 701/118
2012/0173136 A1 * 7/2012 Ghoting ..... G01C 21/3453 701/411
2014/0167969 A1 * 6/2014 Wedig ..... G08B 7/066 340/584
2014/0278052 A1 * 9/2014 Slavin ..... G08G 1/0145 701/400
2014/0358435 A1 * 12/2014 Bell ..... G01C 21/3492 701/527
2015/0073689 A1 * 3/2015 Hampapur ..... G08G 1/0133 701/118
2015/0348406 A1 * 12/2015 Fowe ..... G08G 1/096775 701/118
2016/0269882 A1 * 9/2016 Balthasar ..... G01C 21/00
2016/0334235 A1 * 11/2016 Gustafson ..... G01C 21/3492
2017/0262790 A1 * 9/2017 Khasis ..... G08G 1/012
2018/0061243 A1 * 3/2018 Shloosh ..... G08G 5/0021
2018/0136003 A1 * 5/2018 Perkins ..... G01C 21/362
2019/0011275 A1 * 1/2019 Whinston ..... G01C 21/3492
2019/0019379 A1 * 1/2019 Beller ..... G09B 21/006
2019/0122509 A1 * 4/2019 Beller ..... G08B 7/066
2019/0166009 A1 * 5/2019 Parvin ..... H04L 41/145

* cited by examiner

INCENTIVE-COMPATIBLE, ASYMMETRIC-INFORMATION, REAL-TIME TRAFFIC-ROUTING DIFFERENTIAL-ADVICE

TECHNICAL FIELD

This disclosure pertains generally to computer navigation management, and more specifically to automatically determining and electronically providing incentive-compatible, asymmetric-information, real-time traffic-routing differential-advice to a plurality of drivers and self-driving cars (and other road-based motor vehicles).

BACKGROUND

Serious congestion problems occur when multiple vehicles attempt to depart from or pass through a given location or route simultaneously, beyond a weather-specific threshold that the infrastructure can comfortably accommodate. For example, consider departures from a stadium following a college or professional football game. A large number of drivers depart from the same parking facilities through a limited number of exits and adjoining roadways. Each driver has the same information and expectations as every other driver. The vast bulk expect that their best chance to avoid stifling congestion and minimize the time during which they are stuck in traffic is to leave promptly when the game ends (or to leave early, especially if the game is not close), in order to beat the rush. Of course, the aggregate behavior of such drivers creates a huge traffic tie-up, making exit from lots difficult and time consuming, and further creating additional congestion on the routes leading away from the stadium after exiting the lot, often through several intersections. Any traffic information a driver receives from radio, other broadcasts, or apps such as Google Maps, is the same information obtained by every other driver from these sources. Information suggesting an alternative routing is often accepted by every driver receiving it, seriously diminishing what help that information could offer by creating congestion on the alternative route.

Similar problems are present in other scenarios in which a large number of people attempt to exit a fixed area in a given window of time. This applies not only to other situations in which crowds of people or vehicles attempt to depart events at roughly the same time, but evacuations in the event of natural or other disasters. For example, there has been no substantive progress in hurricane evacuations since Hurricane Katrina in 2005. Estimates of the average speed of evacuation during Katrina range from two to five miles per hour. As cars are limited to traveling much shorter distances on a tank of gas at those speeds, and at much higher engine temperatures, over 1,000 vehicles were reported pulled over on the shoulder of expressways, presumed overheated or out of gas. Additionally, in the attempt to get out of New Orleans, a large enough number of drivers chose to use an exit ramp onto the inbound lanes of expressways so as to substantially reduce average speeds and generate very hazardous driving conditions for first-responders trying to get into the city. As with the drivers leaving a stadium parking lot after a football game, everyone had the same information, and the same expectations about alternative routes. The evacuation order had been broadcast, and the vast majority of drivers started their cars and attempted to leave within minutes of that broadcast. There was no organized plan for evacuation of people without access to a car, or for families with only one car wanting to carry more persons, luggage, medicines and medical devices than the car could handle. When the possessor of the car sought to evacuate family members, low-speed travel crossing intersections where outbound travel was congested became difficult or impossible. For thousands of families, decisions as to the arrival target of evacuations were made without communication or coordination. In particular, children in school were taken to different locations than those chosen by their parents. Several newspapers reported thousands of cases of families unable to locate members for days afterward.

Similar congestion problems also occur whenever multiple vehicles or people attempt to move through a limited infrastructure simultaneously. Consider rush hour traffic. Over sixty years ago, William Vickrey (who later shared the 1997 Nobel Prize in Economics) wrote that average speed at the peak of rush hour could be dramatically increased if every driver ahead of the peak began her/his commute 10 minutes earlier, and every driver after the peak began 10 minutes later. No city or congested bridge (e.g., across the Hudson River, San Francisco or Chesapeake Bay, or at any international border) has found a way to take advantage of Vickrey's theory. Whether radio broadcasts, Google Maps, or Waze, every driver accessing a traffic information source has the same information. A small subset of drivers might be the ones who would benefit most from a given alternative route, because of the totality of their route and ultimate destination. However, these drivers have no way of knowing that. Slow speeds, long commuting times, increases in accidents, and frustration at a level affecting physical health, are all widespread. Similar issues exist with public transportation at rush hour. For example, overcrowded subway stops, as hordes try to catch the same trains at the same times, are neither pleasant nor conducive to good health or good behavior.

It would be desirable to address these issues.

SUMMARY

Incentive-compatible, asymmetric-information, real-time traffic-routing assignments and recommendations are automatically determined and individually provided to multiple participants (e.g., human or automated drivers of cars or other vehicles) traversing through a specific area in association with a given event associated with a particular organization. For one example, the organization can be an athletic association or concert promoter, and the event a sporting event or concert occurring at a specific stadium, arena or venue. At the conclusion of such events, large numbers of drivers attempt to exit and traverse through a physically constrained area at the same time, resulting in congestion. In this example, the venue's parking facilities, exits, nearby streets, intersections, highway ramps, and other potential bottlenecks can all become extremely congested for significant periods of time in these situations.

A set of rules is applied to minimize the time to traverse through the specific area in association with the specific event, summed over the multiple participants, accounting for physical constraints of the specific area and incentive-compatibility constraints concerning the participants. An initial suggested assignment is determined for each specific participant, based on applying the set of rules. Each initial suggested assignment includes a departure time and an initial route for the participant. Updated real-time data concerning physical constraints of the specific area are received, such as real-time traffic information. Real-time recommendations are determined for specific ones of the participants, based on applying the set of rules accounting for the updated real-time data. Real-time recommendations include suggestions to deviate from initial suggested assignments or from previous recommendations, based on the updated information. The initial suggested assignments and real-time recommendations are provided to the corresponding participants, for example by wirelessly communicating with apps running on the participant's mobile computing devices (e.g., by transmitting text messages, graphical mapping indicia, electronic audio commands, etc.). In some embodiments, assignments and recommendations are wirelessly communicated to automated driving systems associated with the participant's smart or self-driving cars. The determined initial suggested assignments and real-time recommendations facilitate real-time routing of traffic that incentivizes minimization of disutility associated with time to traverse through the specific area for the multiple participants.

Applying the set of rules can further comprise distinguishing between the total time to traverse through the area and "stuck" time while traversing through the area, with a greater disutility assigned to stuck time than to total time. Time during which a participant traversing through the specific area is moving at less than a specific threshold speed after initial departure can be classified as stuck time. Applying the set of rules can also further comprise distinguishing between time during which participants are traversing through the area prior to reaching their vehicles (e.g., after the game ends but before an attendee reaches his or her car), and time during which participants are traversing through the area after reaching their vehicles, with a greater disutility assigned to the later. In some embodiments, the set of rules even incentivizes increasing the time prior to reaching a vehicle, for example to encourage attendees to spend some time buying souvenirs or the like. In some embodiments, specific incentive-compatibility constraints to be utilized in applying the set of rules are received from the specific organization. For example, the organization could specify different weights to be applied to the disutility of different classifications of time spent traversing through the area (e.g., stuck time, total time, time before reaching one's car, etc.). The organization can also specify to weigh the disutility of different participants differently, for example to give preference to season-ticket holders or those with premium seating plans or the like.

In one embodiment, applying the set of rules takes the form of applying the prototypical algorithmic objective function $\text{minimize}_{a,r}\ o\ (a,r)=\Sigma_p\ w_m \log_e t_d+\Sigma_p \max(w_s \log_e t_s)$, where p represents individual participants, $t_d$ is the corresponding specific total time, $t_s$ is the corresponding specific stuck time, $w_m$ is the power to which each $t_d$ for each individual participant is raised before summing, and $w_s$ is the power to which each $t_s$ for each individual participant is raised before summing. (a, r) are the long vector of the initial suggested assignments and the long vector of the real-time recommendations, determined by applying the set of rules to minimize the time to traverse through the specific area in association with the specific event, summed over the multiple participants.

The physical constraints of the specific area can be represented as mathematical relationships between traffic density and path-flow-through speed for the corresponding traffic infrastructure, which can be utilized in the set of rules to represent physical constraints in the specific area, to determine the initial suggested assignments and real-time recommendations. In one embodiment, these mathematical relationships are represented as, for each one of multiple paths through a specific point j in the specific area at specific time t, $i_{jt}(a,r)\leq v_{jt}E[F_{jt}|t_{dc}]$, where i is input rate to the specific one of the plurality of paths, v is flow-through volume, f is statistical relation between entry rate and flow-through volume for minimizing time of participants to traverse through the specific area in association with the specific event, and E denotes the expectation operator. The mathematical relationships between traffic density and path-flow-through speed for traffic infrastructure of the specific area can further comprise accounting for the predicted behavior of cars driven by non-participants in the specific area.

Incentive-compatibility constraints, for each participant, concerning the multiple participants can be represented as mathematical relationships between the disutility of total time to traverse through the specific area and the disutility of stuck time while traversing through the specific area for all of the participants, which can be utilized in the set of rules to represent incentive-compatibility constraints concerning the multiple participants to determine the initial suggested assignments and the real-time recommendations. In one embodiment, these mathematical relationships can be represented as, for each vehicle v, $E[t_{dv}+uv_c\ t_{sv}|a,r]\leq E[t_{dv}+u\ t_{sv}|a',r',]\forall(a',r')\neq(a, r)$, where $\forall$ denotes "for all", $t_d$ is total time, $t_s$ is stuck time, u is utility, (a',r') denotes any route other than the recommended one, and E denotes the expectation operator.

Another example scenario in which the functionality described herein can be utilized is rush-hour traffic management (e.g., where the specific organization is a transit authority, the specific event is a time period subject to traffic congestion, and the specific area is a jurisdiction of the transit authority). The functionality can also be used, for example, to manage evacuations (e.g., where a civic authority is responsible for evacuating a city or region in anticipation of a hurricane or other disaster).

The features and advantages described in this summary and in the following detailed description are not all-inclusive, and particularly, many additional features and advantages will be apparent to one of ordinary skill in the relevant art in view of the drawings, specification, and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

The Figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Figure 1:
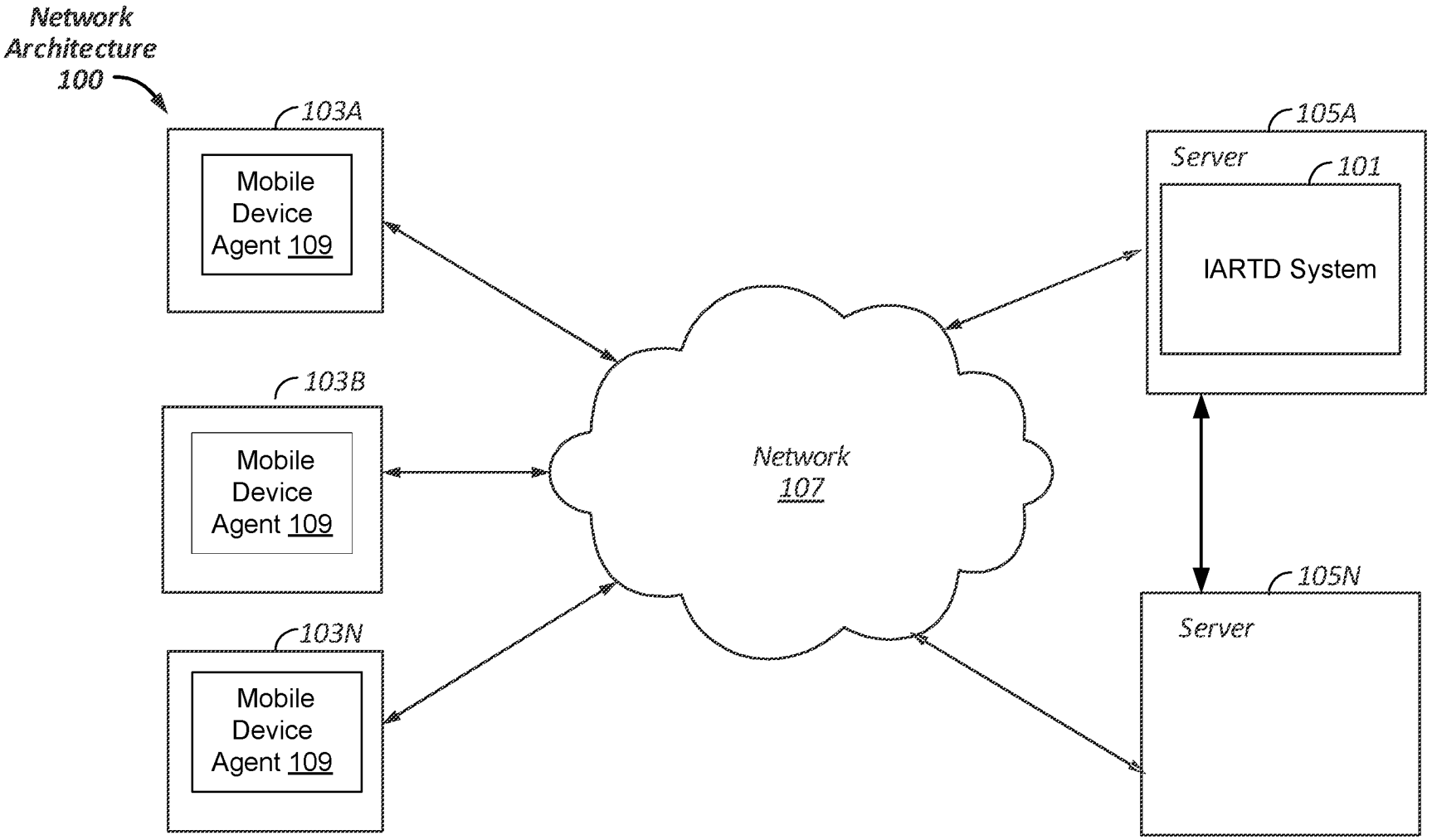
FIG. 1 is a block diagram of an exemplary network architecture in which an incentive-compatible, asymmetric-information, real-time traffic-routing differential-advice system ("IARTD") system can be implemented, according to some embodiments.

FIG. 1 is a block diagram illustrating an exemplary network architecture 100 in which an incentive-compatible, asymmetric-information, real-time traffic-routing differential-advice system ("IARTD") system 101 can be implemented. The illustrated network architecture 100 comprises multiple clients 103A, 103B and 103N, as well as multiple servers 105A and 105N. Although FIG. 1 illustrates three clients 103 and two servers 105A-N as an example, in practice many more (or fewer) clients 103 and/or servers 105 can be deployed. In one embodiment, the network 107 is in the form of the Internet, although other networks can be used in other embodiments, such as a private enterprise-level wide area network.

In FIG. 1, an IARTD system 101 is illustrated as residing on server 105*a*, with a mobile device agent 109*a*, 109*b*, and 109*c* running on each client 103*a*, 103*b*, and 103*c*, respectively. It is to be understood that this is an example only, and in various embodiments various functionalities of an IARTD system 101 can be instantiated on a client 103, a server 105, or can be distributed between multiple clients 103 and/or servers 105.

Clients 103 and servers 105 can be implemented using computer systems 610 such as the one illustrated in FIG. 3 and described below. The clients 103 and servers 105 are communicatively coupled to a network 107, for example via a network interface 648 or modem 647 as described below in conjunction with FIG. 3. Clients 103 are able to access applications and/or data on servers 105 using, for example, the mobile device agent 109, a web browser or other client software (not shown), etc. Clients 103 can be in the form of mobile computing devices, which are portable computer systems 610 capable of connecting to a network 107 and running applications. Some mobile computing devices are referred to as smartphones, although some mobile phones not so designated also have these capabilities. Tablet computers, in-dash or onboard vehicle computing systems, convertible laptops, laptop computers, hybrids, smart watches and other types of wearable computing devices are all examples of mobile computing devices.

Figure 2:
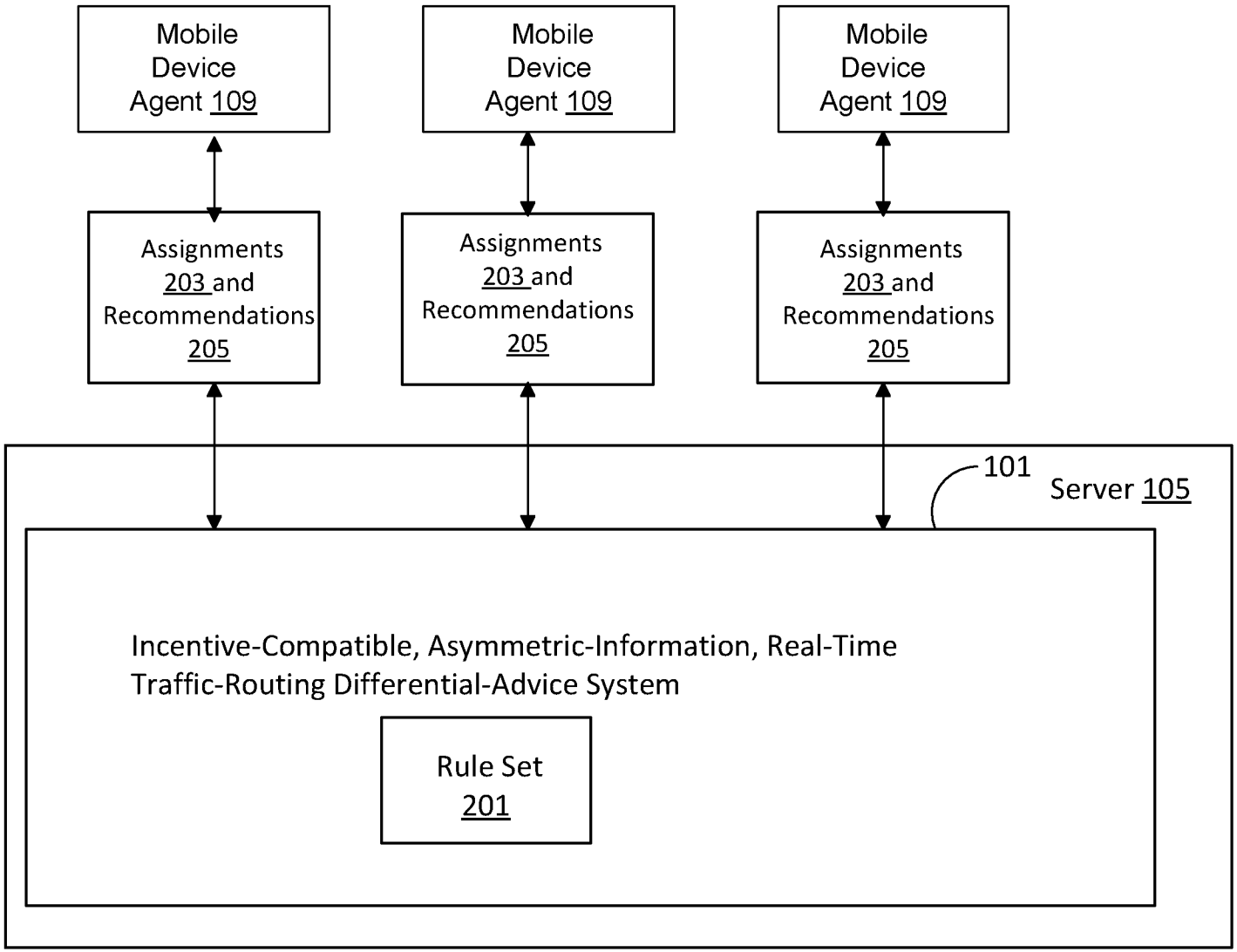
FIG. 2 is a block diagram of the operation of an IARTD system, according to some embodiments.

FIG. 2 illustrates the operation of an IARTD system 101, running on a server 105 and communicating with multiple mobile device agents 109 according to some embodiments. As described above, the functionalities of the IARTD system 101 can reside on a server 105 or other specific computer 610, or be otherwise distributed between multiple computer systems 610, including within a cloud-based computing environment in which the functionality of the IARTD system 101 is provided as a cloud-based service over a network 107. It is to be understood that although the IARTD system 101 is illustrated in FIG. 2 as a single entity, the IARTD system 101 represents a collection of functionalities, which can be instantiated as a single or multiple modules as desired. In some embodiments, the different modules of the IARTD system 101 can reside on different computing devices 610 as desired. Each mobile device agent 109 can be instantiated as an app for a given mobile operating system (e.g., Android, iOS, Windows 10, etc.), with different mobile device agents being specifically implemented for different types of mobile computing devices utilized by different end users.

It is to be understood that the components and modules of the IARTD system 101 can be instantiated (for example as object code or executable images) within the system memory 617 (e.g., RAM, ROM, flash memory) of any computer system 610, such that when the processor 614 of the computer system 610 processes a module, the computer system 610 executes the associated functionality. As used herein, the terms "computer system," "computer," "client," "client computer," "server," "server computer" and "computing device" mean one or more computers configured and/or programmed to execute the described functionality. Additionally, program code to implement the functionalities of the IARTD system 101 can be stored on computer-readable storage media. Any form of tangible computer-readable storage medium can be used in this context, such as magnetic, optical, flash and/or solid-state storage media, or any other type of media. As used herein, the term "computer-readable storage medium" does not mean an electrical signal separate from an underlying physical medium.

As described in detail below, FIG. 2 illustrates the IARTD system 101 applying a given set of rules 201 to make initial suggested assignments 203 and real-time recommendations 205 to multiple parties responsible for operating and navigating (e.g., driving) vehicles (e.g., cars), so as to facilitate the real-time routing of traffic in a manner that incentivizes the individual operators to make decisions that maximize utility for participants, according to inputs and prioritizations of an organization (e.g., a college or professional athletic organization, an event promoter, a municipality, a regional transit authority, etc.). For clarity of description, the term "car" is used herein to refer to any type of vehicle under the guidance of the IARTD system 101. Actual cars are a specific-use case (e.g., trucks, busses, motorcycles, etc., are other possible examples). The term "driver" is used to refer the party in a given vehicle that makes corresponding routing decisions, although in some cases this will not be the person actually operating the vehicle (or may be an automated device or system).

In one embodiment, the set of rules 201 applied by the IARTD system 101 in order to determine and make assignments 203 and real-time recommendations 205 to multiple drivers can be expressed via the following prototypical algorithmic objective function: $\text{Minimize}_{a,r}\ o(a,r)=\Sigma_c w_m \log_e t_d+\Sigma_c \max(w_s \log_e t_s)$. In this objective function, c represents individual cars that are being guided by the IARTD system 101. The objective function is designed to minimize the sum of certain types of costs, summed over all these cars. In this prototypical case the IARTD system 101 treats all cars equally, although certain cars or classes of cars can be assigned weighted prioritizations in other embodiments, as described below. For clarity of illustration and explanation, a c subscript for terms inside the summation is submersed. In the function, $t_d$ is the corresponding particular car's time to destination (e.g., in minutes), whereas $t_s$ is the total number of "stuck" minutes (or other unit of time). Total time to destination can be in the form of the total number of minutes the car will take either to reach its final destination, or to reach the boundary of an area being managed by the IARTD system 101. Stuck time can be time while in the area during which the vehicle is not moving, or is moving below a "stuck threshold" speed. The specific value to use for the stuck threshold is a variable design parameter that can be set differently in different embodiments and under different circumstances as desired (e.g., 0.25 miles/hour, 1 mile/hour, 5 miles/hour, etc.).

In some embodiments, the IARTD system 101 does not simply minimize the sum of these costs. More specifically, in one embodiment, before summing, individual times to destination, $t_d$, are raised to the power $w_m$, a parameter chosen for the application (the objective function is log-linear, $\log_e x^y=y \log_e x$.). For the purpose of this example, suppose $w_m=1.1$. In this embodiment, before summing, individual minutes spent stuck are raised to the power $w_s$ (suppose for example that $w_s=1.4$). The 1.1 power ($w_m$) has the effect that the IARTD system 101 will adjust slightly to let the slowest-moving traffic move faster, even if that slightly increases total driving time. In other words, $w_m$=1.1 gives a slightly higher priority to the slowest-moving traffic. The 1.4 power ($w_s$) gives a notably higher priority to a car that spends a disproportionate number of minutes stuck. This results in a higher priority for reducing the time spent stuck for those cars which will be stuck longer, even if that more-than-slightly increases total driving time. In different use cases, different values can be used for $w_m$ and $w_s$ as desired.

The variables used to accomplish this grand minimization in the function shown above are a, which is shorthand for the long vector of initial suggested assignments 203, and r, shorthand for the long vector of real-time recommendations 205. Applying this function to the totality of the participating cars, the IARTD system 101 determines and makes initial assignments 203 in advance of providing "move" recommendations 205. An initial assignment 203 made to a given driver can include an amount of time for which the car's occupants are recommended to wait before heading to the car (or otherwise depart their current location), as well as an initial planned route. The system also determines and makes real-time recommendations 205 to the drivers, based on application of the rule set 201 (e.g., the function above). A real-time recommendation 205 can be in the form of a suggestion that a particular car change to an alternate routing, for example due to recognition by the IARTD system 101 that the originally assigned routing is showing higher-than-predicted congestion. It is to be understood that the IARTD system 101 can receive real-time information concerning traffic, weather and other conditions, and, taking this updated data into account, apply the set of rules 201 to determine real-time recommendations 205 to specific drivers to change their routes, adjust their departures times, etc. Although assignments 203 and real-time recommendations 205 are made separately, both seek to minimize the same objective function. Note that initial assignments 203 and real-time recommendations 205 are in fact both a form of recommendations. This approach to congestion reduction results in scenarios which are not command-and-control. Instead, participants work with the IARTD system 101 to reduce traffic congestion because they themselves are incentivized to do so, by the reduction of total and/or stuck time they experience when participating. When drivers are so incentivized, they likely are willing to voluntarily follow assignments 203 and real-time recommendations 205.

In one embodiment, specific organizations (e.g., athletic associations, event promoters, municipalities) purchase, contract for or otherwise obtain use of a specific implementation of the IARTD system 101 configured to their specifications, and make their instantiation available to drivers or other users who are their customers, charges, etc. For example, a college athletic association could purchase an implementation of the IARTD system 101 configured to guide drivers out of the parking facilities at their stadium after football games. Individuals who purchase tickets could then be offered use of the IARTD system 101, for example by downloading the mobile device agent 109 to their smartphones (e.g., in the form of an app), and receiving initial assignments 203 and real-time recommendations 205 from the IARTD system 101, for example in the form of text messages, graphical indicia on maps displayed on mobile devices screens, electronic audio commands (e.g., voice simulated driving directions through the mobile device speaker or car audio system), or any combination of such textual, graphical and/or audio output to the drivers.

It is to be understood that while participating organizations are not expected to understand the mathematical meaning of $w_m$ and $w_s$ (e.g., the 1.1 and 1.4 powers), organization can be prompted to enter configuration criteria indicating weights of importance to assign to total time and stuck time, based for example on an organization's perceived importance of these factors to the drivers under its jurisdiction (e.g., how likely the organization thinks total time to destination relative to the total minutes spent being stuck is to result in driver resentment, complaints, and refusals to participate, etc.). The IARTD system 101 can provide default values, and in some embodiments organizations may configure these values up and down as desired, for example through a system administrator dashboard or other user-interface. The values 1.1 and 1.4 are used as examples to illustrate a scenario in which time spent stuck is adjudged to have greater disutility per passing minute than the total time to reach the chosen destination, and hence is assigned greater weight for overall minimization. Oftentimes drivers are more frustrated by stuck time than longer total drive time, but the specific weightings for these factors are configurable parameters.

In some embodiments the objective function can include a third summation not shown in the formula above, but which does not fundamentally change the nature of the mathematical relationships involved. As shown above, the objective function starts counting "time to destination" $t_d$ when the event (e.g., the game) ends. Suppose, though, that the organization believes that the disutility of an additional minute spent remaining at the event (e.g., to talk with persons seated nearby, to purchase souvenirs, to purchase and consume food, or to take photos and selfies) is valued differently than the disutility of arriving at the destination one minute later. In such a case, "time to destination" for that organization can be redefined to start when a driver reaches the car (or physically departs the stadium, enters the parking lot, etc.), with "added time spent at the event before going to the car" $t_a$ added into the objective function separately, for the sole reason that $t_a$ can be raised to a different power than $t_d$ before summing, to reflect the organization's belief about its separate disutility. In other words, the specific rule set 201, as expressed in the mathematical relationships between the parameters of the formula, can be modified between embodiments and use cases to account for different disutilities and relative weightings between them.

It is further possible that an organization desires that people remain on the premises (e.g., in the stadium) after the event finishes, for example to spend more money on concessions. In such a scenario, longer "added time spent at the event before going to the car" is viewed as a positive, at least up to a point. This can be addressed by an adjustment to multiply the summed $t_a$'s by a small negative coefficient before entering them into the objective function. Because going too far with this type of preference could frustrate drivers, in some embodiments the IARTD system 101 alerts an organization to the potential dangers when such weighting is introduced, for example by suggesting to classify only, say, the first 10 minutes of "added time spent at the event before going to the car" as $t_a$, with "time to destination" starting 10 minutes after the event ends. Note that the specific suggestions, alerts, warnings, defaults and other interaction specifics between the IARTD system 101 and organization level administrators can vary between embodiments as desired.

Note also that the objective function as presented above treats all cars potentially participating as equally important. In some embodiments, an organization may treat disutility of different drivers or classes of drivers differently. For one example, luxury-box purchasers or season-ticket holders could be weighted above other customers at the event. For another, cars containing more passengers who had attended the event could be given greater weight (these two examples are not mutually exclusive). Both examples could be accommodated by incorporating a coefficient larger than 1 for the cars of such drivers, multiplied to the time measure after it had been raised to the relevant power.

For each organizational scenario (e.g., exit management after a specific sporting event at a given stadium/arena, or after a concert at a given venue), data concerning relevant physical constraints is input into the IARTD system 101. For example, each parking lot serving the stadium is physically constrained by the number of cars that can leave per period of time via each exit without resulting in dramatically lower speeds through the exit than the street it reaches, thereby causing cars to get stuck in the lot before reaching the exit. For each parking area, exit, street, intersection, ramp, etc., there exists some given limitation of the number of vehicles that can pass per period of time without creating excessive congestion. Thus, the IARTD system 101 can account for the physical constraints of each potential bottleneck in the area being managed in a given scenario, such as each path through an affected intersection, each entry ramp onto an expressway, each change in the number of available lanes, etc. This data can be obtained, for example, from traffic surveys as to the relation between traffic density and path-flow-through speed. In different embodiments the data concerning the physical constraints of specific traffic infrastructure can be received and/or otherwise obtained from different sources as desired. This data can be updated in real-time as new information becomes available. For example, as noted above, real-time information concerning changes to traffic, weather, road conditions, lane closures, etc., can be received in real-time. The IARTD system 101 applies these data to constrain (a, r), the initial assignments 203 and real-time recommendations 205. These constraints can incorporate additional information such as traffic-light timing, lane openings and closures, etc. In some instances the organization will not be able to control these factors (e.g., where the organization is a private party and the traffic-light is controlled by a public utility). In other situations, the organization can obtain control (e.g., the organization is the municipality or the bottleneck is on private property). The specific target volumes of traffic throughput per unit of time used by the IARTD system 101 for given potential bottlenecks are variable design parameters, and can be adjusted as desired.

The physical constraints affecting the traffic throughput in an area under the management of the IARTD system 101 in a given scenario are represented mathematically, and built into the instantiation of the rule set 201 used by the IARTD system 101 in that implementation. To the extent consistent with objective-function minimization, and accounting for the predicted behavior of cars driven by nonparticipants, initial assignments 203 to individual drivers of when to head to their respective cars will be constrained by these values.

In one embodiment, these physical constraints are of the form, for each path through an intersection (from direction n,s,e,w), or an entry ramp j at time t (measured from t=0 at the end of the event): $i_{jt}(a,r) \leq v_{jt} E[f_{jt}|t_{dc}]$, where i is the input rate to that path, v the flow-through volume and f the (statistically) expected relation between entry rate and flow-through volume for minimizing the time to get participants to their destinations (thus, E denotes the expectation operator). In other embodiments, variations in these mathematical relationships can be used to represent the physical constraints as desired.

The IARTD system 101 also applies incentive-compatibility constraints. It is to be understood that incentive-compatibility constraints are a major aspect missing from conventional command-and-control traffic management systems. Drivers will not agree to participate unless they believe they will reach their destination at least as quickly, and with as little disutility, as if they simply chose the departure time and route on their own, not accepting the system's recommendations. Participation is voluntary, but of course the IARTD system 101 will function more effectively if a larger fraction of the vehicles within the area under its management [a] have their cellphones turned on, offering location information, and [b] are following assignments 203 and real-time recommendations 205. Therefore, on any one usage of the IARTD system 101 it is unwise to issue any assignment 203 or recommendation 205 which the driver would on average be better off not following. These incentive-compatibility constraints are even more important in situations where the IARTD system 101 will be used repeatedly by the same organization, which would typically be the case for most organizations, if not all. The rate of future driver participation will heavily be determined by effectiveness of the IARTD system 101 as perceived by the participants, both directly in terms of their future incentives to participate and follow recommendations, and indirectly in the impact the system 101 effectiveness will have on other potential participants, who learn of this information via social media, word of mouth, etc.

These incentive-compatibility constraints can be represented mathematically in the form, for each car c: $E[t_{dc}+u_c t_{sc}|a,r] \leq E[t_{dc}+u\, t_{sc}|a', r'], \forall(a', r') \neq (a, r)$, where $\forall$ is read "for all." In words, this specifies that on average, the weighted sum of {time to destination+time stuck} is at least as low should the driver be following the system's recommendations as for any other feasible recommendations the driver might consider following, where the weighted sum uses that driver's tradeoff between $t_d$ and is ($u_c$ will be greater than 1 if the driver is more irked by an extra minute stuck than by an extra (moving) minute required to reach his destination, and greater for drivers with a stronger difference between these disutilities). Note that in this context, making a "feasible" recommendation merely rules out recommending paths that do not lead to the desired destination, or that involve driving behaviors prohibited by law, such as driving on the sidewalk or the wrong side of a road or expressway, proceeding through red lights, etc.

To initially express incentive compatibility constraints straightforwardly, the above inequality abstracts from two aspects. First, the IARTD system 101 does not know the true value of $u_c$, which is a matter of personal preference which may not even be known precisely by the driver himself or herself (especially when passengers' disutilities are taken into account). Thus, the IARTD system 101 will account for this by satisfying the constraint for driver c for all values of $u_c$ within some reasonable interval $U=[\check{u},\hat{u}]$. Adding this complication yields, for each car c: $E[t_{dc}+u_c t_{sc}|a,r] \leq E[t_{dc}+u\, t_{sc}] \forall(a', r') \neq (a, r), \forall u_c \in U$. Note that the specific parameters used for the interval are a variable design choice. Second, "on average" is a simplification unlikely to be acceptable to most organizations. Thus, organizations will be allowed to specify a threshold T, so that each participant finds the incentive constraint holding for him or her not just on average, but with probability at least T. To focus on this aspect, incentive compatibility constraints can be stated more simply by submersing the first aspect: $\text{Prob}\{[t_{dc}+u_c t_{sc}|a,r] \leq [t_{dc}+u\, t_{sc}|a', r']\} \geq T, \forall(a',r') \neq (a, r)$.

It is possible that an organization choosing to have certain preferred customers given higher priority will wish to use a higher threshold T in the incentive-compatibility constraint relating to those customers than to "normal" customers.

Thus, by applying the functionality described above, the IARTD system 101 applies a set of rules 201 (basically mathematical relationships expressed by, for example, the prototypical algorithmic objective function described above) that improve computer-related traffic management technology by allowing the making of initial assignments 203 and real-time recommendations 205 to multiple parties responsible for operating and navigating (e.g., driving) vehicles (e.g., cars), so as to facilitate the real-time routing of traffic in a manner that incentivizes the individual operators to make decisions that maximize the utility for participants, according to inputs and prioritizations of an organization. This enables the computerized performance of a function not previously performable by a computer, specifically the automated provision of incentive-compatible, asymmetric-information, real-time traffic-routing differential-advice that takes into account incentive-compatibility constraints. In strict contrast to conventional command-and-control traffic management systems, the IARTD system 101 avoids issuing any assignment 203 or recommendation 205 to any driver which the driver would on average be better off not following (or, in some embodiments would be worse off following only with a specified low probability).

As an aid to understanding the operation of the IARTD system 101 according to several example embodiments, certain specific use cases are now described. It is to be understood that these are examples only, and other uses are both possible and contemplated. As noted above, one use case for the IARTD system 101 is managing traffic exiting from a fixed, physically constrained area such as the parking facilities of a specific stadium after the conclusion of a specific event, such as a college or professional football game. In this scenario, information for each participating driver such as the driver's parking spot, seats, and destination upon departure are obtained, for example via each driver's instance of the mobile device agent 109 (e.g., smartphone app). In some cases, some of this information is already known to the IARTD system 101 (e.g., the driver's seats, where the driver is a season ticket holder, or the driver's default destination, where the driver is a repeat participant). Information such as parking space can be gleaned automatically by the mobile device agent 109 (e.g., by GPS or other location identifying functionality on the driver's mobile device) and/or input by the driver. The exact information obtained for the drivers varies between use cases as desired.

The IARTD system 101 can send each driver an individualized text message, app alert or other electronic communication, suggesting a time for his/her group to leave their seats and head to the car. The IARTD system 101 can choose these times so that [a] the number of cars attempting exit at any given time is kept below bottleneck levels, and [b] the number of cars attempting to traverse any given path (e.g., arriving northbound, turning left through an immediate traffic-signal-controlled intersection, entering a given highway via a specific on-ramp, etc.) at any given time is kept below bottleneck levels. The IARTD system 101 can transmit to each driver an initial assignment 203 comprising an individualized initial recommended route to the corresponding destination. This initial recommendation is received by the mobile device agent 109 on the driver's mobile device. The device agent 109 uses the initial assignment 203 to provide navigation instructions to the driver (e.g., via graphical indicia on a map and/or audio output and/or by controlling or otherwise interfacing with the routing aspect of an automated driving system). The IARTD system 101 can update an initial recommendation 203 by transmitting real-time recommendations 205 to the driver's mobile device agent 109 as traffic conditions suggest better alternatives. The mobile device agent 109 then provides updated real-time instructions to the driver. In one embodiment, drivers not using a smartphone can be called, texted, or otherwise electronically contacted by the IARTD system 101 with computer-generated real-time recommendations 205 as to changes in recommended routes to individual destinations.

As noted above, another use case for the IARTD system 101 is hurricane (or other disaster) evacuations. In one embodiment, for a given metropolitan area in a hurricane zone, two types of data can be gathered ahead of hurricane season, and updated as necessary: [a] data on possible evacuation routes, including traffic density/average speed, bottleneck densities, and data on arrival sites and the capacities and resources to be present at each; and [b] voluntarily supplied data on households to be evacuated (e.g., work, school, and home addresses, and usual times at addresses, together with which cars are likely at which addresses when; resources required at an arrival site) and on first responders to be positioned (similar data). The IARTD system 101 can be run well before hurricane season for possible evacuation scenarios (e.g., workday, weekend, day, night), and re-optimized to be re-run when needed.

On the evening before a possible evacuation, the IARTD system 101 could send one designated member of each household a text message or other alert about recommended preparations (e.g., things to pack and put in car trunks). Working with federal, state and local emergency-preparedness teams, the operator of the IARTD system 101 could encourage provision of, say, an hour advance notice to the IARTD system 101 of any evacuation order that is to be broadcast.

The IARTD system 101 could (first priority) send individualized recommendations of times and routes for hospitals to be evacuated; then (second priority) for schools, for example. Routes for first responders could be projected to minimize interference from evacuees (both those participating in the use of the IARTD system 101 and those on their own), and could be individualized and sent in one format (e.g., text or other alert type) to non-moving first responders, and in another (e.g., audio alert or voice message) to responders on the move. Individual voluntary participants in evacuation could also be sent individualized messages as desired. For example, an initial communication to an evacuee could state: "We recommend that you stay where you are, keep calm, and leave for your car at such time as to be in your car 41 minutes from now. You will then be sent a recommendation between 41 and 43 minutes from now to start your car. The routing app on your smartphone will provide an initial recommended route to your arrival location. The app will automatically recommend re-routing whenever that can help avoid congestion. If you follow our recommendations, you will reach the same arrival location as the rest of your household, at least as soon and likely sooner than if you decide to go on your own."

For rush-hour traffic management, studies and other empirical data concerning relevant routes, expressways and local roads, at different times and under different weather conditions, can be used to supply density/speed figures, and bottleneck densities for routes, exit and entry ramps, local-road traffic-light-controlled intersections, etc.

Potentially participating drivers provide their usual destinations for morning and afternoon commutes, together with needed morning arrival times, and earliest possible departure times. These usual destinations and times can be modified for a particular day, or indefinitely as a result of change in home or office location, for example via a user interface on the mobile device agent 109 or a web interface to the IARTD system 101. Information concerning vacations, sick days, changes in schedule, etc., can also be supplied. Last-minute changes may receive lower priority.

Initial assignments 203 for morning departure times can be provided to the mobile device agents 109 of the participating drivers by the IARTD system 101 the night before, at an evening hour of the driver's choosing. In the morning, a driver could, for example, be given advance notice of a recommendation to depart M minutes earlier (e.g., 20 minutes), for example 3M minutes before the initially planned time (e.g., 60 minutes notice for 20 minutes earlier departure). The IARTD system 101 can tailor reminders of planned departure times to individual preferences (e.g., 10-minute warning only, also 5-minute warning, etc.). A recommendation 205 indicates to start now, with an initially assigned route 203. The IARTD system 101 can then provide real-time recommendations 205 to account for route-changes based on updated conditions and the like. A driver starting late (or early) is automatically detected by the driver's mobile device agent 109, which transmits this information to the IARTD system 101, which can then adjust the recommendations 205 accordingly. Similarly, a driver who plans to leave work late on a given day is encouraged to provide an updated estimate. Unannounced late departures can be automatically detected, and the IARTD system 101 can adjust recommendations 205 accordingly. The IARTD system 101 also adjusts for the behavior of nonparticipating drivers, which can be discerned, for example, from speeds at which cell phones pass cell towers.

Figure 3:
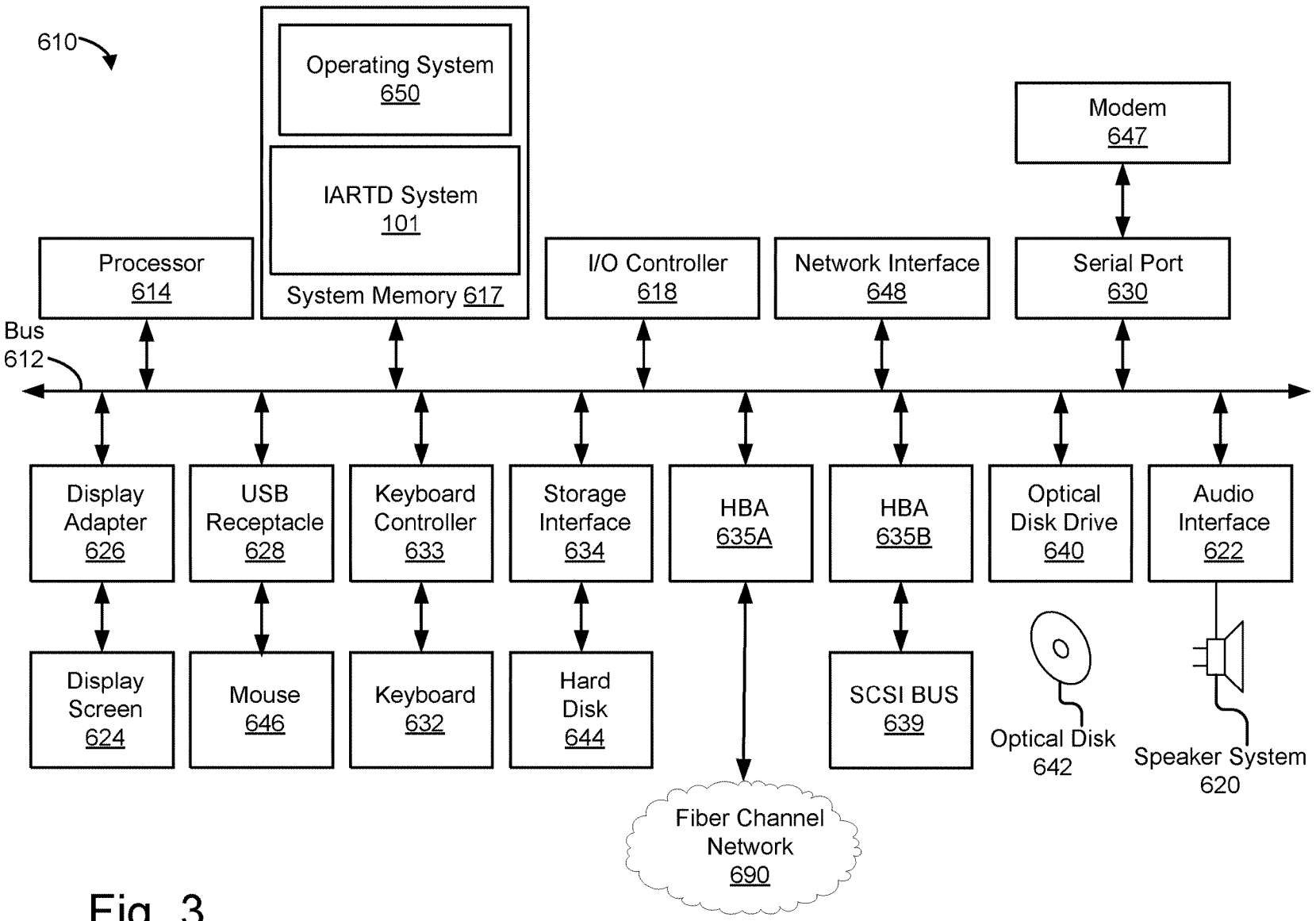
FIG. 3 is a block diagram of a computer system suitable for implementing an IARTD system, according to some embodiments.

FIG. 3 is a block diagram of an example computer system 610 suitable for implementing an IARTD system 101. Both clients 103 and servers 105 can be implemented in the form of such computer systems 610. As illustrated, one component of the computer system 610 is a bus 612. The bus 612 communicatively couples other components of the computer system 610, such as at least one processor 614, system memory 617 (e.g., random access memory (RAM), read-only memory (ROM), flash memory), an input/output (I/O) controller 618, an audio output interface 622 communicatively coupled to an audio output device such as a speaker 620, a display adapter 626 communicatively coupled to a video output device such as a display screen 624, one or more interfaces such as Universal Serial Bus (USB) receptacles 628, serial ports 630, parallel ports (not illustrated), etc., a keyboard controller 633 communicatively coupled to a keyboard 632, a storage interface 634 communicatively coupled to one or more hard disk(s) 644 (or other form(s) of storage media), a host bus adapter (HBA) interface card 635A configured to connect with a Fibre Channel (FC) network 690, an HBA interface card 635B configured to connect to a SCSI bus 639, an optical disk drive 640 configured to receive an optical disk 642, a mouse 646 (or other pointing device) coupled to the bus 612, e.g., via a USB receptacle 628, a modem 647 coupled to bus 612, e.g., via a serial port 630, and one or more wired and/or wireless network interface(s) 648 coupled, e.g., directly to bus 612.

Other components (not illustrated) may be connected in a similar manner (e.g., document scanners, digital cameras, printers, etc.). Conversely, all of the components illustrated in FIG. 3 need not be present (e.g., smartphones and tablets typically do not have optical disk drives 640, external keyboards 632 or external pointing devices 646, although various external components can be coupled to mobile computing devices via, e.g., USB receptacles 628). The various components can be interconnected in different ways from that shown in FIG. 3.

The bus 612 allows data communication between the processor 614 and system memory 617, which, as noted above may include ROM and/or flash memory as well as RAM. The RAM is typically the main memory into which the operating system 650 and application programs are loaded. The ROM and/or flash memory can contain, among other code, the Basic Input-Output system (BIOS) which controls certain basic hardware operations. Application programs can be stored on a local computer readable medium (e.g., hard disk 644, optical disk 642) and loaded into system memory 617 and executed by the processor 614. Application programs can also be loaded into system memory 617 from a remote location (i.e., a remotely located computer system 610), for example via the network interface 648 or modem 647. In FIG. 3, the IARTD system 101 is illustrated as residing in system memory 617.

The storage interface 634 is coupled to one or more hard disks 644 (and/or other standard storage media). The hard disk(s) 644 may be a part of computer system 610, or may be physically separate and accessed through other interface systems.

The network interface 648 and/or modem 647 can be directly or indirectly communicatively coupled to a network 107 such as the internet. Such coupling can be wired or wireless.

As will be understood by those familiar with the art, the invention may be embodied in other specific forms without departing from the spirit or essential characteristics thereof. Likewise, the particular naming and division of the portions, modules, agents, managers, components, functions, procedures, actions, layers, features, attributes, methodologies, data structures and other aspects are not mandatory or significant, and the mechanisms that implement the invention or its features may have different names, divisions and/or formats. The foregoing description, for purpose of explanation, has been described with reference to specific embodiments. However, the illustrative discussions above are not intended to be exhaustive or limiting to the precise forms disclosed. Many modifications and variations are possible in view of the above teachings. The embodiments were chosen and described in order to best explain relevant principles and their practical applications, to thereby enable others skilled in the art to best utilize various embodiments with or without various modifications as may be suited to the particular use contemplated.

What is claimed is:

1. A computer-implemented method for automatically providing incentive-compatible, asymmetric-information, real-time traffic-routing assignments and recommendations to a plurality of participants traversing through a specific area in association with a specific event associated with a specific organization, the method comprising:

applying, via a computer, a set of rules to minimize time to traverse through the specific area in association with the specific event, summed over the plurality of participants, accounting for physical constraints of the specific area and incentive-compatibility constraints concerning the plurality of participants, wherein applying the set of rules further comprises simultaneously, for the plurality of participants, applying a prototypical algorithmic objective function to specific total times and corresponding specific stuck times for each participant of the plurality;

determining, via the computer, a specific initial suggested assignment for each specific one of the plurality of participants based on applying the set of, each specific initial suggested assignment comprising at least a specific departure time and a specific initial route;

providing, by the computer, each specific initial suggested assignment to a corresponding specific automated driving system associated with each corresponding specific participating vehicle;

receiving, via the computer, from automated driving systems associated with participating vehicles, updated real-time data concerning physical constraints of the specific area, the received updated data comprising at least real-time traffic information;

determining, by the computer, real-time recommendations for specific ones of the plurality of participants based on applying the set of rules accounting for updated real-time data concerning physical constraints of the specific area, each real-time recommendation comprising a suggestion to a corresponding participating vehicle to deviate from a corresponding initial suggested assignment or from previous real-time recommendation;

instantly transmitting, by the computer, the determined real-time recommendations to respective automated driving systems associated with corresponding specific ones of the-participating vehicles wherein automated driving systems associated with specific ones of the participating vehicles automatically process received determined real-time recommendations, automatically resulting in improved transit times for the specific ones of the participating vehicles; and wherein the determined initial suggested assignments and the determined real-time recommendations include different departure times for different groups of participants among the plurality of participants for facilitating real-time routing of traffic that incentivizes minimization of disutility associated with time to traverse through the specific area for the plurality of participants.

2. The method of claim 1 wherein applying the set of rules further comprises:

distinguishing between total time to traverse through the specific area and stuck time while traversing through the specific area; and assigning a greater disutility to stuck time than to total time.

3. The method of claim 2 wherein applying the set of rules further comprises:

classifying time during which a participant traversing through the specific area is moving at less than a specific threshold speed after a corresponding departure time as stuck time.

4. The method of claim 2 wherein applying the set of rules further comprises:

applying a prototypical algorithmic objective function $\text{minimize}_{a,r}\ o(a, r)=\Sigma p\ w_m \log_e t_d+\Sigma_p \max(w_s \log_e t_s)$, where p represents individual participants of the plurality, $t_d$ is a corresponding specific total time, $t_s$ is a corresponding specific stuck time, $w_m$ is a power to which each $t_d$ for each individual participant is raised before summing, and $w_s$ is a power to which each $t_s$ for each individual participant is raised before summing; and where (a, r) are a long vector of the initial suggested assignments and a long vector of the real-time recommendations, determined by applying the set of rules to minimize the time to traverse through the specific area in association with the specific event, summed over the plurality of participants.

5. The method of claim 1 wherein applying the set of rules further comprises:

distinguishing between time traversing through the specific area prior to reaching a vehicle to be used to transit the specific area and time traversing through the specific area after reaching the vehicle; and assigning a greater disutility to time traversing through the specific area after reaching the vehicle.

6. The method of claim 5 wherein applying the set of rules further comprises:

incentivizing increasing of time traversing through the specific area prior to reaching the vehicle.

7. The method of claim 1 further comprising:

receiving, via the computer from the specific organization, specific incentive-compatibility constraints to be utilized in applying the set of rules.

8. The method of claim 7 wherein receiving, via the computer from the specific organization, specific incentive-compatibility constraints to be utilized in applying the set of rules further comprises:

receiving, via the computer from the specific organization, different weights to apply to disutility of different classifications of time traversing through the specific area; and applying the received different weights to disutility of different classifications of time traversing through the specific area.

9. The method of claim 7 wherein receiving, via the computer from the specific organization, specific incentive-compatibility constraints to be utilized in applying the set of rules further comprises:

receiving, via the computer, from the specific organization, a directive to weight disutility of different participants differently; and weighing disutility of different participants differently according to the received directive.

10. The method of claim 1 wherein providing initial suggested assignments and real-time recommendations to participants further comprises:

wirelessly communicating with apps running on mobile computing devices associated with participants.

11. The method of claim 1 wherein providing initial suggested assignments and real-time recommendations to participants further comprises:

wirelessly communicating with automated driving systems associated with participants.

12. The method of claim 1 further comprising:

representing physical constraints of the specific area as mathematical relationships between traffic density and path-flow-through speed for traffic infrastructure of the specific area; and utilizing the mathematical relationships between traffic density and path-flow-through speed for traffic infrastructure of the specific area in the set of rules to represent physical constraints in the specific area to determine the initial suggested assignments and the real-time recommendations.

13. The method of claim 12 further comprising:

representing the mathematical relationships between traffic density and path-flow-through speed for traffic infrastructure of the specific area as, for each of a plurality of paths through a specific point j in the specific area at a specific time t, $i_{jt}(a, r) \leq v_{jt} E[f_{jt}|t_{dc}]$, where i is input rate to a specific one of the plurality of paths, v is flow-through volume, f is a statistical relation between entry rate and flow-through volume for minimizing time of participants to traverse through the specific area in association with the specific event, and E denotes an expectation operator; and where (a, r) are a long vector of the initial suggested assignments and a long vector of the real-time recommendations, determined by applying the set of rules to minimize the time to traverse through the specific area in association with the specific event, summed over the plurality of participants.

14. The method of claim 12 wherein representing the mathematical relationships between traffic density and path-flow-through speed for traffic infrastructure of the specific area further comprises:

accounting for predicted behavior of cars driven by non-participants in the specific area.

15. The method of claim 1 further comprising:

representing incentive-compatibility constraints concerning the plurality of participants as mathematical relationships between disutility of total time to traverse through the specific area and disutility of stuck time while traversing through the specific area for all participants of the plurality; and utilizing the mathematical relationships between disutility of total time to traverse through the specific area and disutility of stuck time while traversing through the specific area for all participants of the plurality in the set of rules to represent incentive-compatibility constraints concerning the plurality of participants to determine the initial suggested assignments and the real-time recommendations.

16. The method of claim 15 further comprising:

representing the mathematical relationships between disutility of total time to traverse through the specific area and disutility of stuck time while traversing through the specific area for all participants of the plurality as, for each vehicle v, $E[t_{dv}+uv_c\ t_{sv}|a, r] \leq E[t_{dv}+u\ t_{sv}|a', r']$, $\forall(a', r') \neq (a, r)$, where V denotes for all, $t_d$ is total time, $t_s$ is stuck time, u is utility and E denotes an expectation operator; and where (a, r) are a long vector of the initial suggested assignments and a long vector of the real-time recommendations, determined by applying the set of rules to minimize the time to traverse through the specific area in association with the specific event, summed over the plurality of participants, and (a', r') represent any other feasible (assignment, recommendation) pair.

17. The method of claim 1 wherein:

the specific organization is an athletic association;

the specific event is a sporting event or an athletic event occurring at a specific stadium or arena at a specific time;

the specific area is proximate to the specific stadium or arena; and the participants are attendees of the sporting event.

18. The method of claim 1 wherein:

the specific organization is a promoter of live performance events;

the specific event is a live performance occurring at a specific venue at a specific time;

the specific area is proximate to the specific venue; and the participants are attendees of the concert.

19. The method of claim 1 wherein:

the specific organization is at least one transit authority;

the specific event is a period subject to traffic congestion occurring over a specific period of time;

the specific area is a jurisdiction of the at least one transit authority; and the participants are commuters within the jurisdiction of the at least one transit authority.

20. The method of claim 1 wherein:

the specific organization is at least one civic authority;

the specific event is an evacuation;

the specific area is a jurisdiction of the at least one civic authority; and the participants are evacuees within the jurisdiction of the at least one civic authority.

* * * * *